US010316437B2

(12) United States Patent
Roh et al.

(10) Patent No.: US 10,316,437 B2
(45) Date of Patent: Jun. 11, 2019

(54) YARN PLYING APPARATUS

(71) Applicants: Jung-Sim Roh, Seoul (KR); Byung Deok Kim, Uijeongbu-si (KR)

(72) Inventors: Jung-Sim Roh, Seoul (KR); Byung Deok Kim, Uijeongbu-si (KR)

(73) Assignees: SANGMYUNG UNIVERSITY SEOUL, Seoul (KR); INDUSTRY-ACADEMY COOPERATION FOUNDATION, Seoul (KR)

( * ) Notice: Subject to any disclaimer, the term of this patent is extended or adjusted under 35 U.S.C. 154(b) by 182 days.

(21) Appl. No.: 15/619,092

(22) Filed: Jun. 9, 2017

(65) Prior Publication Data

US 2018/0057971 A1 Mar. 1, 2018

(30) Foreign Application Priority Data

Aug. 30, 2016 (KR) ..... 10-2016-0110437

(51) Int. Cl.
*D02G 3/28* (2006.01)

(52) U.S. Cl.
CPC ..... *D02G 3/28* (2013.01)

(58) Field of Classification Search
CPC ..... D02G 3/28
See application file for complete search history.

(56) References Cited

U.S. PATENT DOCUMENTS 2,349,639 A * 5/1944 Theiler ..... B65H 49/06 242/131.1
2,442,775 A * 6/1948 Nelson ..... D02G 3/285 57/58.3
2,483,160 A * 9/1949 Suggs ..... D02H 1/00 211/165
3,041,007 A * 6/1962 Tripp ..... B65H 49/12 242/130
3,067,704 A * 12/1962 Pedersen ..... D05B 87/02 112/225
3,168,996 A * 2/1965 Vossen ..... D04B 3/00 242/131
3,969,884 A * 7/1976 Inohara ..... D01H 1/006 57/58.54
4,130,046 A * 12/1978 Sokol ..... D04C 3/42 87/44
5,083,420 A * 1/1992 Rupert ..... D01H 4/50 57/263
5,275,175 A * 1/1994 Poirier ..... A61G 13/04 128/845
5,694,873 A * 12/1997 Wu ..... D05B 43/00 112/302

(Continued)

*Primary Examiner* — Ismael Izaguirre
(74) *Attorney, Agent, or Firm* — John K. Park; Park Law Firm

(57) ABSTRACT

Disclosed herein is a yarn plying apparatus which is able to ply two or more than two yarns, for example, a natural yarn, a synthetic yarn or a metal filament. In the present invention, the yarn packages are arranged in a radial shape at a regular interval on the base. The yarns are plied at the plying guide hole formed just above the center of the base, so the length and angles to the plying hole of the yarns moving to the plying hole are constant, whereby the constant tensile force can be maintained. Even when the thusly plied yarns are covered or twisted, the constant twisting can be obtained.

3 Claims, 5 Drawing Sheets

(56) References Cited

U.S. PATENT DOCUMENTS

| | | | | |
|---|---|---|---|---|
| 8,177,154 | B1 * | 5/2012 | Hoover | B65H 49/16<br>242/131 |
| 2006/0150880 | A1 * | 7/2006 | Prufer | D05B 43/00<br>112/302 |

* cited by examiner

YARN PLYING APPARATUS

TECHNICAL FIELD

The present invention relates to a yarn plying apparatus which is able to ply yarns in multiple structures, which are plied multiple times, wherein two and more than two strands have different materials and physical properties, and in particular to a yarn plying apparatus wherein a multiple-plied type yarn consisting of any of a natural yarn, a synthetic yarn and a metal filament is plied using a yarn plying apparatus of the present invention and is covered and plied in multiple structures for a variety of uses, thus preparing a composite yarn which will be used for a weaving work, a knitting work or a needlework. The present invention relates to a yarn plying apparatus which is able to ply the yarns consisting of multiple strands through an intermediate step to prepare a multiple-plied composite yarn which can be used in various industrial fields.

BACKGROUND ART

In a conventional technology, a yarn processing apparatus, in general, is made in double structures so as to prepare a new yarn by plying two or more than two yarns, one of which is referred to a ring twisting type (a twist type) wherein a plied and twisted yarn is prepared in such a way to ply the same kind of yarns while twisting them and then to twist them again, and the other one of which is referred to an Italian twisting type (a covering type) wherein different kinds of yarns are prepared in such a way to wrap an effect yarn around a core yarn and then ply them.

Needs for a plied yarn are being diversified, which is configured to provide a new feeling and performance and may be made by plying yarns different in thickness, flexibility, strength, etc. In order to ply in safe the yarns having different physical properties, a combined method, in general, may be used, wherein a core yarn is covered with an effecting yarn.

If a plurality of yarns are plied and supplied to the core yarn and covered with an effecting yarn, the conventional yarn plying machine of the Italian twisting type may arrange a plurality of yarn packages wherein a yarn which will be plied is wound around a bobbin, in a row and the horizontal direction on a base of the Italian twisting machine, and then the plying is carried out.

The yarns will be plied as they pass through a plying guide installed in the center of the package wherein the yarn packages are arranged in a row in the horizontal direction, and the yarn of the yarn package is arranged. The yarn consists of multiple strands released from the packages arranged in a row is not under the same conditions in terms of the angle and distance to the plying guide, thus causing a problem.

In case of the yarn released from the yarn package positioning just below the plying guide, the direction where the yarn releases, is same as the direction where the yarn is being supplied, and the distance to the plying guide becomes shortest; however, in case of the yarn released from the package positioning at a portion getting farther from a portion just below the plying guide to both ends, the direction wherein the yarn releases, is not same as the direction where the yarn is being supplied, for which the length of the yarn supplied to the plying guide becomes longest. If the angles defined with respect to the plying points where the yarns released from the packages are not same, the unwinding of the yarn is not constant, and if the lengths of the yarns supplied to the plying portion are different, the tensile force of the yarns supplied from the packages are not constant, so the supply of the yarns of constant lengths from the plying portion may not be appropriately carried. If the thusly plied yarns are subjected to the multiple-plying and twisting process, the twisted state may not be constant, and the appearance may be uneven. For this reason, the quality may become worse when knitting or weaving or needle-working a woven fabric in such a way to use the composite yarns.

A plurality of unbalanced composite yarns made of component yarns of different physical properties are plied again and are used as a core yarn, and if a multiple plied composite yarn is prepared by covering the plied yarns with an another effect yarn and then plying the covered plied yarns is made, the quality degradation due to the unbalance in the yarn supply is very serious.

In recent years, the needs for a conductive metal composite yarn used for an electrical conduction of a high-tech wearable thing in the field of health, sports, military, etc. continue to increase.

In case of a conductive metal composite yarn used for a high-tech wearable thing, the conductive metal composite yarn must maintain a constant electrical performance, not damaged, with respect to an external force that the wearable thing continuously receives during the use of such a wearable thing. If the supply of the component yarns is unstable during the multiple-plying process of the conductive metal composite yarn, the finished conductive metal composite yarn may not maintain a constant tensile force, and the exterior thereof may look uneven. For this reason, the finished metal composite yarn may be easily damaged during the fabrication of weaving, knitting, needlework, etc. or the use of the product, which may cause an error or a problem.

Moreover, as another problem of the conventional plying assistant apparatus, a fixing means for loading a yarn package is fixed at a regular interval, so if the interval of between neighboring fixing means is narrow, the yarn package with a large unwinding balloon of the yarn cannot be used. Furthermore, if the yarns which will be plied, is large in number, the fixing means of the yarn package must be added in the horizontal direction, thus causing a problem.

Moreover, in the conventional yarn plying assistant apparatus, the yarn packages are fixed vertical with respect to the ground. If the yarn packages are fixed vertical, the angles of the yarn packages cannot be adjusted, so the yarn packages which will be plied, cannot maintain the constant angles with respect to the plying guide.

In order to maintain a constant tensile force of the yarn released from the package, it is preferred that the yarn package shaft faces in the direction of the plying guide point.

The configuration and operation of the yarn plying apparatus will be described. There is the Korean patent registration number 10-1181610 (a multifunction covering composite machine (hereinafter referred to a prior technology 1) filed by the same applicant as the present invention.

The prior technology 1 is referred to an apparatus which aims to manufacture a covered composite yarn having various functions. The configuration of this apparatus will be described.

The mechanical configuration for obtaining an improved productivity and lower error occurrence may be good; however, if a plurality of yarns used as a core yarn must be arranged for a covering yarn, it needs to provide a structure wherein yarn packages are arranged in a row at the base of a system like a conventional covering machine. In this case, multiple strands of the yarns released from the yarn packages arranged in a row in the horizontal direction cannot be under the same condition in terms of the angle and distance to the plying guide point, which may correspond to the problem of a conventional covering machine. For this reason, the unwinding of the yarn is not smooth, and the lengths of the yarns supplied to the plying point may be different from each other, so the tensile force of the yarns supplied from the package may become inconstant, and the supply of the yarns having constant lengths from the yarn package to the plying point may not be appropriately carried out. The problem is that it might excessively occupy the installation surface area in the horizontal direction of the machine body.

Moreover, there are the Korean patent registration number 10-0881957 "a twisting apparatus of a compound yarn" (hereinafter referred to a prior technology 2), and the Korean patent registration number 10-0917108 (hereinafter referred to a prior technology 3).

The prior technology 2 is referred to an apparatus wherein a process for first twisting the component yarn consisting of multiple strands and then plying and then re-twisting it, thus preparing a plied and twisted yarn using one machine apparatus. In order to shorten the manufacturing time of a plied and twisted yarn which, in general, is prepared through many twisting, the configurations of a conventional two-for-one apparatus and a ring twister are combined; however such an apparatus is configured in a structure which is unavailable to prepare a plied and twisted yarn made through less twisting and a composite yarn of a covering type. Moreover, since it is constructed in such a way that the yarn can pass fast through the inside and outside of the bobbin in order for four time twisting to be carried out for every rotation of the spindle, in case of a conductive metal composite yarn including a metal filament which is weak to friction, a lot of friction and tensile force may generate when the metal filament passes through the multiple guides, and the direction may change, so the metal filament may be damaged during the process. For this reason, it is hard to achieve the purpose of the present invention.

The prior technology 3 is referred to a complex twisted thread system wherein a first twister and a second twister are installed together, thus concurrently carrying out the twisting and plying processes. It is also referred to an apparatus wherein the packages around which a yarn has been wound, are arranged in a triangle shape, thus twisting a plied and twisted yarn consisting of two strands.

According to the aforementioned apparatus, the yarn bobbin is disposed laid in the horizontal direction on a rotation circular plate. The yarn is first twisted as the rotation circular plate rotates, and as the bobbin raid horizontal rotates, the yarn is supplied to the plying position, and the twisted yarns are collected and twisted again, thus preparing a plied and twisted yarn. This apparatus is like a configuration corresponding to a horizontal structure of a conventional ring twister or a two-for-one device. More specifically, the method wherein the twisting is carried as the circular plate on which the bobbin is laid horizontal, rotates and the method wherein the yarn is supplied as the bobbin laid horizontal rotates correspond to the method for preparing a plied and twisted yarn in a twisting way. Moreover, the productivity of the plied and twisted to yarn is low. According to the aforementioned apparatus, it is impossible to form a covered and multiple-plied composite yarn in such a way to combine the covered yarns composed of two component yarns having different physical properties in two or more than two strands with an effect yarn.

DISCLOSURE OF THE INVENTION

Accordingly, it is an object of the present invention to provide a yarn plying apparatus which is able to resolve the problems encountered in the conventional plying assistant apparatus of a covering composite machine wherein a composite yarn due to the unbalance in the supply of yarns.

In the present invention, a plurality of yarn packages are arranged on a base in a radial shape at a regular interval. The yarn is plied by a plying guide hole formed just above the center of the base, so the distance to the plying hole of the yarn collected toward the plying hole can be constant, and the unwinding angles of the yarn unwound from the yarn package can be defined constant in the direction of the plying hole. Consequently, the smooth unwinding is available, and the constant tensile force loaded on the unwinding yarns can be maintained. The twisting and exterior can look constant when covering them with an effect yarn or twisting the thusly plied yarn.

Moreover, the interval of a yarn package fixing member can be freely adjusted in order for a yarn package of a large volume and a yarn package of a small volume to be conveniently used in a plying apparatus through movements. The angle of the yarn package fixing member can be easily adjusted in order for the yarn to be released at a wide angle.

To achieve the above object, two or more than two guide rails are fixed on the upper surface of a circular base. A movable member which is movable in the directions of the inside and outside of the guide rail, is disposed on the guide rail. A bobbin shaft configured to insert and erect the yarn package and a yarn package fixing means equipped with a yarn package angle adjusting means are disposed on the movable member, and a moving distance indication scale is formed at the guide rail.

Advantageous Effects

In the present invention, even though the yarn consisting of multiple strands is plied, the distance from the yarn package to the plying point can be constant, yarn package shafts can face the plying guide hole and the angle of the unwinding yarns to the plying point can be constant, and the tensile force is constant, so the plied state can become constant. When the yarn is covered by an effect yarn and twisted again, the twisted state can become constant, which may result in an enhanced product quality, and in case of an electrically conductive metal composite yarn, a constant current and voltage can be maintained.

Moreover, in the guide rail fixed on the base, since the movable member on which the yarn packages are mounted, can be freely movable in the inward and outward directions on the guide rail, the interval of each yarn package fixing member is widened in such a way to move the movable member in the outward direction if the volume of the yarn package is large, so the yarn package of a large volume can be used. If the volume of the yarn package is small, a yarn package of a small volume can be used in such a way to move the movable member in the inward direction.

The angle of the yarn package fixing package can be easily adjusted to the plying guide hole, which makes it possible to freely adjust the angle of the yarn package in a state where the yarn can be smoothly released if the yarn is wound much or little.

BRIEF DESCRIPTION OF THE DRAWINGS

The present invention will become better understood with reference to the accompanying drawings which are given only by way of illustration and thus are not limitative of the present invention, wherein.

MODES FOR CARRYING OUT THE INVENTION

Figure 1:
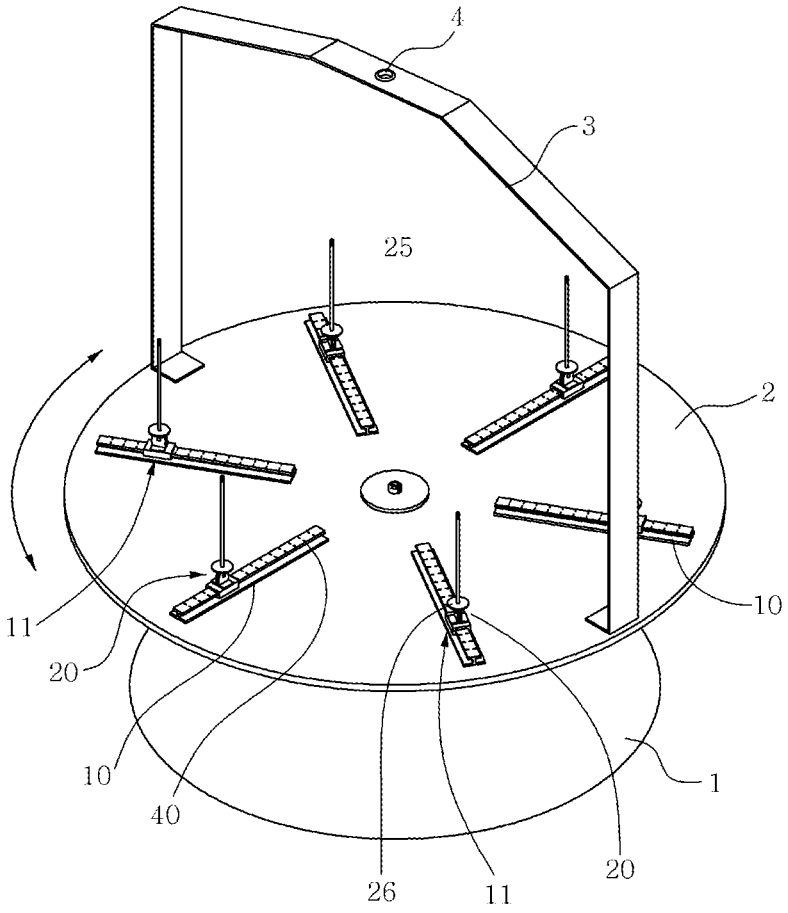
FIG. 1 is a perspective view illustrating the whole configuration of the present invention.
Figure 2:
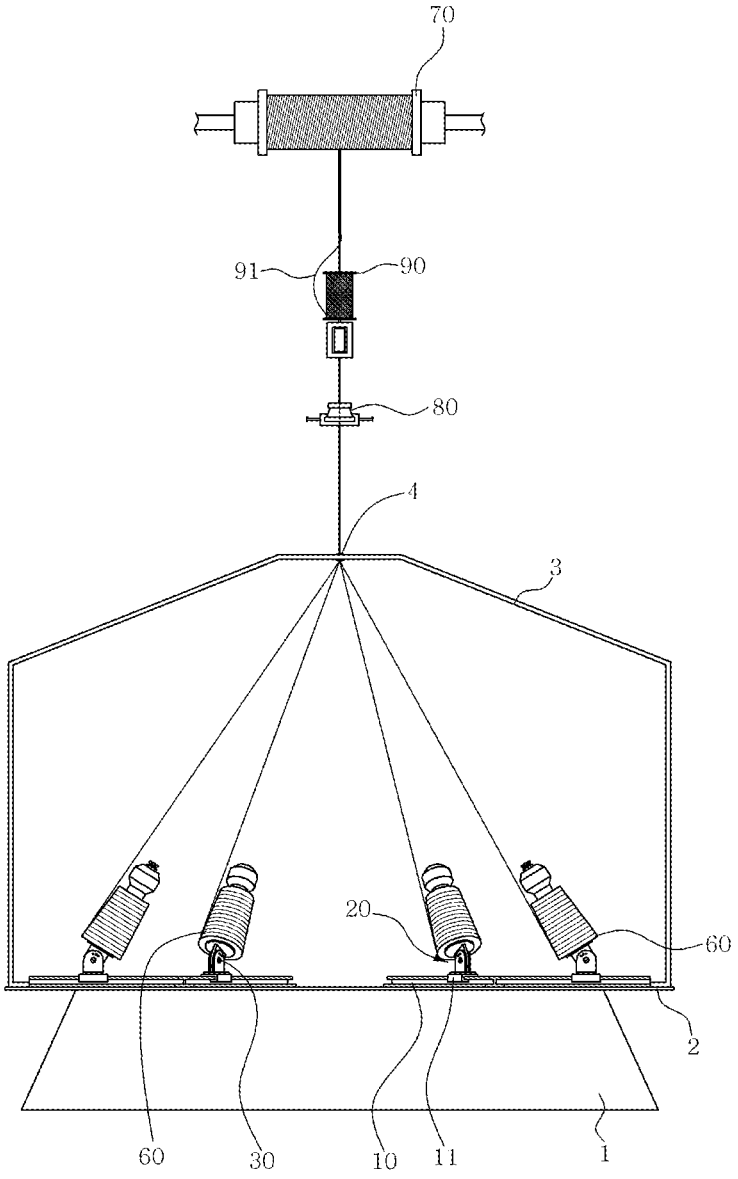
FIG. 2 is a front view for describing an embodiment of the present invention.
Figure 3:
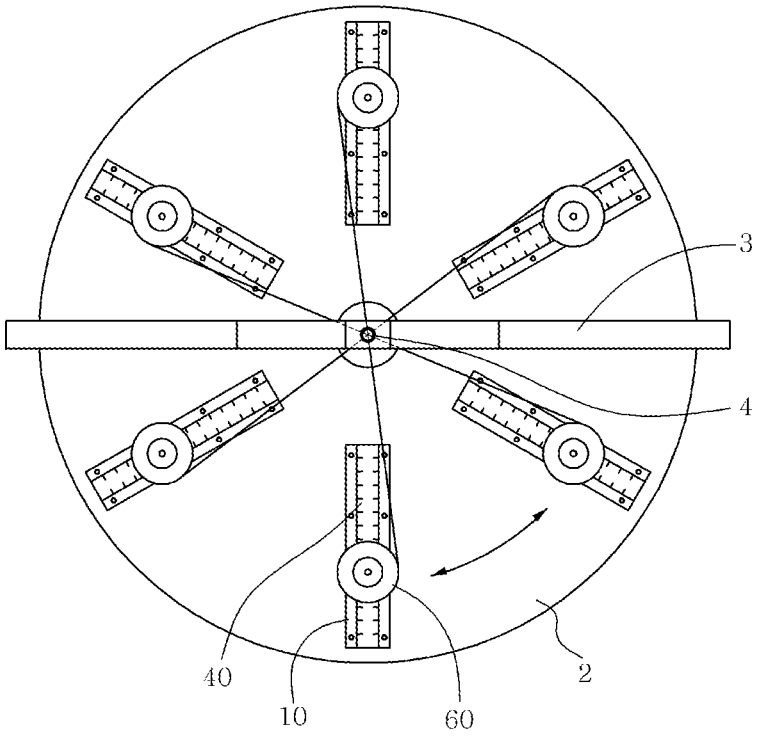
FIG. 3 is a plane view of the present invention.
Figure 4:
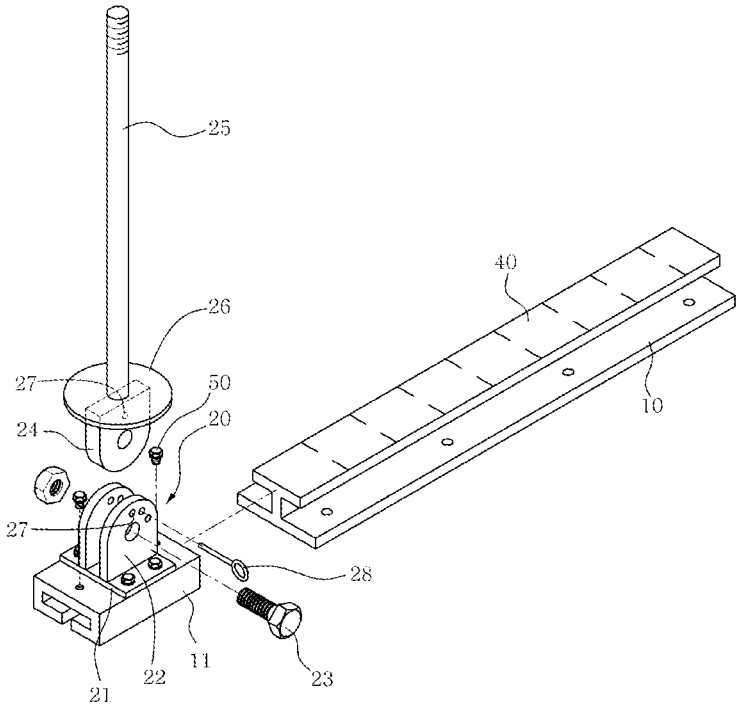
FIG. 4 is a disassembled perspective view illustrating major components of the present invention.
Figure 5:
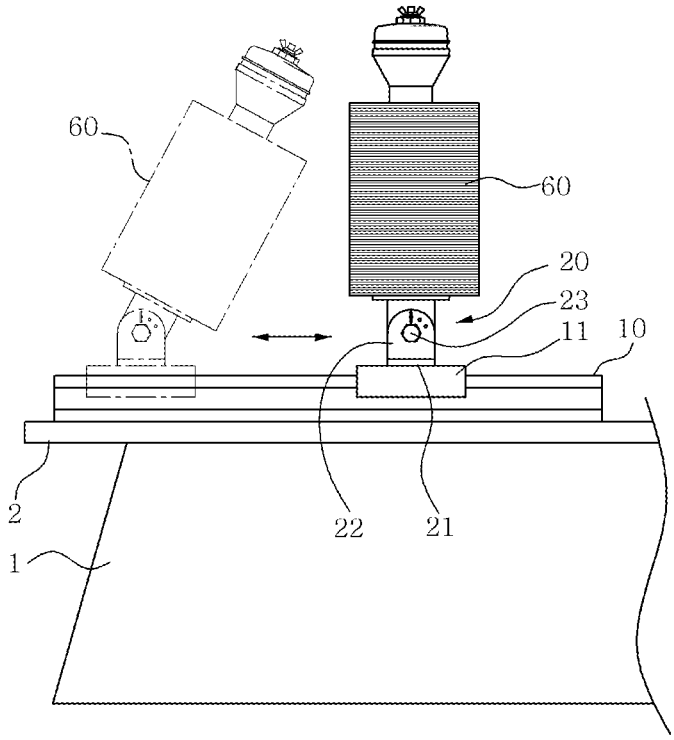
FIG. 5 is an enlarged view illustrating the major components in the operations of the present invention.

The present invention will be described with reference to the accompanying drawings.

The yarn plying apparatus according to the present invention may include, but is not limited to a circular base 2 which is installed rotatable on a resting part 1; a plying support part 3 which includes a plying guide hole 4 in the center, wherein both ends of the plying support part 3 are fixed at the base 2; a guide rail 10 which is fixed in a radial shape at the upper surface of the circular base 2; a movable member 11 which is inserted in the guide rail 10 and is movable in the inward and outward directions; a yarn package fixing part 20 which is fixed at the movable member 11; a yarn package angle adjusting means 30 which is provided at the yarn package fixing means 20; and a yarn package moving distance adjusting scale 40 which is indicated at the guide rail 10.

The yarn package fixing part 20 includes a support member 21 which is fixed on the movable member 11 and includes a support wall 22 at the front and rear parts of the upper surface, a rotation plate 24 which is provided at the lower part thereof and is engaged through a support wall 22 and a rotation shaft 23 for the rotation plate to be rotatable inserted in the support wall 22 of the support member 21, and a yarn package resting plate 26 equipped with a bobbin shaft 25 in the center of the upper surface, wherein the bobbin of the yarn package is inserted in the bobbin shaft 25.

The support wall 22 of the support member 21 and the rotation plate 24 include an angle adjusting hole 27 which allow adjusting the angle of the yarn package, and a fixing pin 28 which is inserted in the angle adjusting hole 27 and allows adjusting the angle of the yarn package.

In the drawings, reference number 50 represents a movable member fixing piece, 60 represents a yarn package, 70 represents a plied yarn bobbin around which a plied yarn is wound, 80 represents a yarn guide, 90 represents a covering yarn package, and 91 represents a covering yarn wrapped around the plied yarn prepared by the apparatus of the present invention.

The operation and effects of the present invention will be described.

The yarn package fixing part 20 is fixed at the movable member 11 inserted in the guide rail 10 fixed in a radial shape at a regular interval on the upper surface of the circular base 2, so it can be movable in the inward and outward directions along the movable member 11 and the guide rail 10. If the volume of the yarn package is large, the interval of the yarn package fixing part 20 fixed at the movable member 11 can be widened by moving in the outward direction the movable member 11, whereby the yarn package of a large volume can be used. The yarn package of a small volume can be used in such a way to move in the inward direction the movable member 11.

The yarn package fixing part 20 may include, but is not limited to, a support member 21 equipped with a support wall 22 at its upper surface, and a yarn package resting plate 26 equipped with a rotation plate 24 at its lower surface. The rotation plate 24 is inserted in the support plate 22 and is engaged rotatable to a rotation shaft 23, so the angle of the yarn package inserted in a bobbin shaft 25 of the yarn package fixing part can be freely adjusted, whereby it is possible to adjust the angle at which the yarn can be most smoothly released.

A fixing pin 28 is inserted in an angle adjusting hole 27 formed at the support wall 22 and the rotation plate 24 after the angle of the yarn package has been adjusted, by which the yarn package can be fixed at a desired angle.

A yarn package moving distance adjusting scale 40 is indicated on the upper surface of the guide rail 10. So, the movable member 20 can be moved in the inward or outward direction by a desired distance. The yarn packages of a variety of volumes, therefore, can be conveniently used.

In the apparatus of the present invention, the yarn packages are arranged in a radial shape at the circular base, and the yarns of each package are collected at the plying guide hole 4 formed in the center of a plying support part 3 and are plied. Since the plying is carried out in the center, the yarns released from the packages can be plied at the same lengths, so the lengths and tensile force can be constant. In this state, if the plied yarns are twisted, the twisting will be constant. In case of the metallic yarn which is electrically conductive, the constant current and stable voltage can be maintained, so the present invention can well apply to a high-tech wearable thing, etc.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

<Legend of reference number>

| | |
|---|---|
| 1: Resting part | 2: Circular base |
| 3: Plying support part | 4: Plying guide hole |
| 10: Guide rail | 11: Movable member |
| 20: Yarn package fixing part | 21: Support member |
| 22: Support wall | 23: Rotation shaft |
| 24: Rotation plate | 25: Bobbin shaft |
| 26: Yarn package resting plate | 27: Angle adjusting hole |
| 28: Fixing pin | 30: Angle adjusting part |
| 40: Moving distance adjusting scale | |

What is claimed is:

1. A yarn plying apparatus, comprising:

a circular base (2) which is installed rotatable at a resting part (1);

a plying support part (3) which includes a plying guide hole (4) in the center, wherein both ends of the plying support part (3) are fixed at the base (2);

a plurality of guide rails (10) which are fixed in a radial shape at the upper surface of the circular base (2);

a movable member (11) which is inserted in the guide rails (10) and is movable in the inward and outward directions;

a yarn package fixing means (20) which is fixed at the movable member (11);

a yarn package angle adjusting means (30) which is provided at the yarn package fixing means (20); and a yarn package moving distance adjusting scale (40) which is indicated at the guide rails (10).

2. The apparatus of claim 1, wherein the yarn package fixing means (20) includes a support member (21) which is fixed on the movable member (11) and includes a support wall (22) at the front and rear parts of the upper surface, a rotation plate (24) which is provided at the lower part thereof and is engaged through a support wall (22) and a rotation shaft (23) for the rotation plate (24) to be rotatable inserted in the support wall (22) of the support member (21), and a yarn package resting plate (26) equipped with a bobbin shaft (25) in the center of the upper surface, wherein the bobbin of the yarn package is inserted in the bobbin shaft (25).

3. The apparatus of claim 2, wherein the support wall (22) of the support member (21) and the rotation plate (24) include an angle adjusting hole (27) which allow adjusting the angle of the yarn package, and a fixing pin (28) which is inserted in the angle adjusting hole (27) and allows adjusting the angle of the yarn package.

* * * * *